US008910601B2

(12) United States Patent
Choi et al.

(10) Patent No.: US 8,910,601 B2
(45) Date of Patent: Dec. 16, 2014

(54) CYLINDER AIR VOLUME DIFFERENCE ADJUSTER AND CONTINUOUS VARIABLE VALVE LIFTER INCLUDING THE SAME

(71) Applicant: Hyundai Motor Company, Seoul (KR)

(72) Inventors: Byong Young Choi, Bucheon-si (KR); Jin Kook Kong, Suwon-si (KR); Young Hong Kwak, Suwon-si (KR); Soo Hyung Woo, Yongin-si (KR); Gee Wook Shin, Ansan-si (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 14/040,263

(22) Filed: Sep. 27, 2013

(65) Prior Publication Data

US 2014/0090616 A1 Apr. 3, 2014

(30) Foreign Application Priority Data

Sep. 28, 2012 (KR) ..... 10-2012-0109084

(51) Int. Cl.
*F01L 1/34* (2006.01)
*F01L 1/04* (2006.01)
*F01L 13/00* (2006.01)

(52) U.S. Cl.
CPC ..... *F01L 1/04* (2013.01); *F01L 13/0063* (2013.01)
USPC ..... 123/90.16; 123/90.39

(58) Field of Classification Search
CPC ..... F01L 1/04; F01L 13/0063
USPC ..... 123/90.16, 90.39
See application file for complete search history.

(56) References Cited

U.S. PATENT DOCUMENTS 7,363,893 B2 * 4/2008 Rohe et al. ..... 123/90.16

FOREIGN PATENT DOCUMENTS

| | | |
|---|---|---|
| JP | 11-324625 | 11/1999 |
| JP | 2001-123809 A | 5/2001 |
| JP | 2004-092552 A | 3/2004 |
| JP | 2005-098279 A | 4/2005 |

* cited by examiner

*Primary Examiner* — Zelalem Eshete
(74) *Attorney, Agent, or Firm* — McDermott Will & Emery LLP

(57) ABSTRACT

A continuous variable valve lifter having a cylinder air volume difference adjuster includes a camshaft having an input cam, an eccentric control shaft disposed parallel to the camshaft, and a control link rotatable around the eccentric control shaft. An output cam is provided to open and close a valve actuator for opening/closing, and a connection link is rotatably connected to the control link, and driving the output cam by the rotation of the input cam. A cam cap is disposed where the camshaft and the eccentric control shaft are mounted.

The cylinder air volume difference adjuster includes a hinge pin serving as the rotational center of the output cam disposed parallel to the camshaft, a pin holder where the hinge pin is mounted, and an adjusting bolt for selectively shifting the position of the pin holder.

15 Claims, 7 Drawing Sheets

CYLINDER AIR VOLUME DIFFERENCE ADJUSTER AND CONTINUOUS VARIABLE VALVE LIFTER INCLUDING THE SAME

CROSS-REFERENCE TO RELATED APPLICATION

This application claims priority to and the benefit of Korean Patent Application No. 10-2012-0109084 filed in the Korean Intellectual Property Office on Sep. 28, 2012, the entire contents of which are incorporated herein by reference.

TECHNICAL FIELD

The present disclosure relates to a cylinder air volume difference adjuster and a continuous variable valve lifter including the same, and more particularly, to a cylinder air volume difference adjuster which is capable of adjusting a difference in the air volume of each cylinder while the engine is running and a continuous variable valve lifter including the same.

BACKGROUND

An internal combustion engine burns fuel and air in a combustion chamber to generate power. Intake valves are operated by a camshaft in order to intake the air, and the air is drawn into the combustion chamber while the intake valves are opened. In addition, exhaust valves are operated by the camshaft, and combustion gas is exhausted from the combustion chamber while the exhaust valves are opened.

An optimal operation of the intake valves and the exhaust valves depends on rotation speed of the engine. That is, an optimal lift or optimal opening/closing timing of the valves depends on rotation speed of the engine. In order to achieve such an optimal valve operation which depends on the rotation speed of the engine, various research, such as designing a plurality of cams and a variable valve lift (VVL) to change valve lift according to engine speed, has been undertaken.

The existing continuous variable valve lifter (CVVL) does not directly adjust air volume difference between cylinders, but instead adjusts valve lift difference.

That is, air volume differences are preferably adjusted by adjusting the valve lift differences. However, air volume differences still exist even with the same lifter due to manufacturing deviations in peripheral parts of intake valves, and there are limits on how precise the adjustment can be.

A conventional method for valve lift difference adjusts thickness of a shim/spacer inserted in a shaft. However, adjusting lift difference is difficult since the shim/spacer cannot be replaced while the CVVL is in operation.

Moreover, to check if lift difference adjustment has been done to a desired level, it is necessary to stop the CVVL, replace the shim/spacer with a part having a desired thickness, and operate the CVVL, which is cumbersome.

In addition, air volume differences still exist due to manufacturing deviations in peripheral parts of intake valves even after adjusting the lift difference to some extent. Therefore, precisely adjusting an air volume difference with the conventional lift difference adjustment method has limitations.

The above information disclosed in this Background section is only for enhancement of understanding of the background of the present disclosure, and therefore it may contain information that does not form the prior art already known in this country to a person of ordinary skill in the art.

SUMMARY

The present disclosure has been made in an effort to provide a cylinder air volume difference adjuster capable of adjusting the difference in the air volume of each cylinder while the engine is running, and a continuous variable valve lifter including the same.

A cylinder air volume difference adjuster for a continuous variable valve lifter includes a camshaft having an input cam, an eccentric control shaft disposed parallel to the camshaft, and a control link rotating around the eccentric control shaft. The cylinder air volume difference adjuster further includes a valve actuator for opening/closing, an output cam provided to open and close the valve actuator, a connection link rotatably connected to the control link and driving the output cam by the rotation of the input cam and a cam cap where the camshaft and the eccentric control shaft are mounted. The cylinder air volume difference adjuster may further include a hinge pin serving as the rotational center of the output cam disposed parallel to the camshaft, a pin holder where the hinge pin is mounted, and an adjusting bolt for selectively shifting the position of the pin holder.

The adjusting bolt may have an adjusting bolt eccentric cam formed thereon. The adjusting bolt eccentric cam may move the pin holder by selectively rotating the adjusting bolt, and thus adjusting a difference in the air volume of each cylinder.

An adjustment hole may be formed in the pin holder, and the adjusting bolt eccentric cam may be inserted into the adjustment hole, and thus moving the pin holder along with the rotation of the adjusting bolt.

The cylinder air volume difference adjuster may include an adjusting bolt lock nut for fixing the adjusting bolt in the cam cap, and a lock bolt for fixing the pin holder to the cam cap.

The bottom of the cam cap may be inclined, and the pin holder may move along an inclined surface of the cam cap.

A continuous variable valve lifter according to another exemplary embodiment of the present invention includes a camshaft having an input cam, an eccentric control shaft disposed parallel to the camshaft, and a control link rotating around the eccentric control shaft. The continuous variable valve lifter further includes a valve actuator for opening/closing. An output cam is provided to open and close the valve actuator, a connection link is rotatably connected to the control link and driving the output cam by the rotation of the input cam. A cam cap, where the camshaft and the eccentric control shaft are mounted, and a cylinder air volume difference adjuster are provided. The cylinder air volume difference adjuster may further includes a hinge pin serving as the rotational center of the output cam disposed parallel to the camshaft, a pin holder where the hinge pin is mounted, and an adjusting bolt for selectively shifting the position of the pin holder.

The adjusting bolt may have an adjusting bolt eccentric cam formed thereon, and the adjusting bolt eccentric cam may move the pin holder by selectively rotating the adjusting bolt, and thus adjusting a difference in the air volume of each cylinder.

An adjustment hole may be formed in the pin holder, and the adjusting bolt eccentric cam may be inserted into the adjustment hole, thus moving the pin holder along with the rotation of the adjusting bolt.

The cylinder air volume difference adjuster may further include an adjusting bolt lock nut for fixing the adjusting bolt in the cam cap and a lock bolt for fixing the pin holder to the cam cap. The bottom of the cam cap may be inclined, and the pin holder may move along an inclined surface of the cam cap.

A cam roller may be disposed at a connecting portion of the control link and the connecting link, contacting the input cam.

The valve actuator may be a swing arm valve and may be a tappet valve.

According to the embodiments of the present invention, the cylinder air volume difference adjuster and the continuous variable valve lifter including the same are capable of adjusting a difference in the air volume of each cylinder while the engine is running, and therefore allowing more precise adjustment of the difference in air volume.

Since differences in air volume between each cylinder can be adjusted more precisely, a lower lift profile can be achieved, and further, the air-to-fuel ratio under idle and low load conditions can be improved.

DETAILED DESCRIPTION

Figure 1:
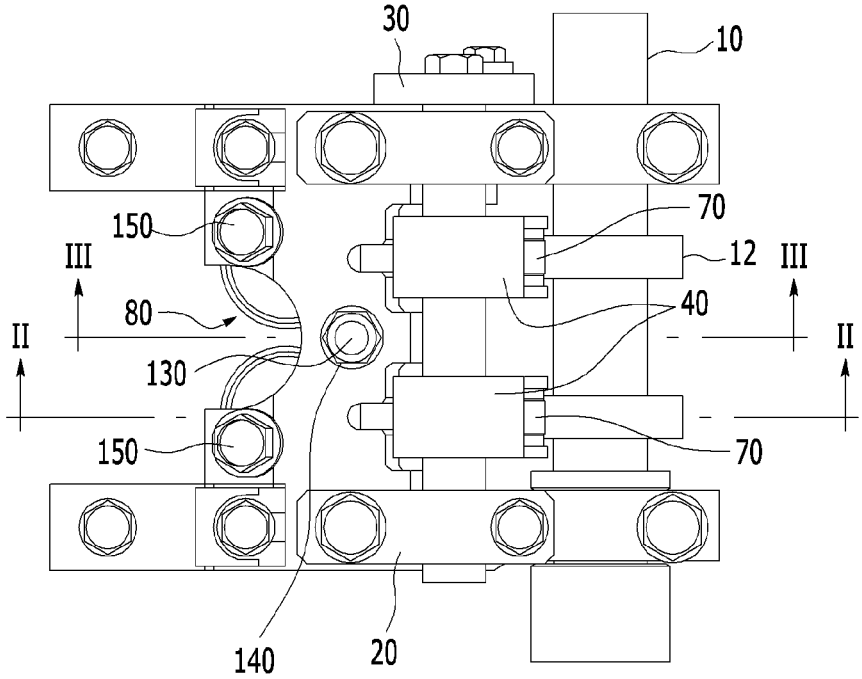
FIG. 1 is a top plan view of a cylinder air volume difference adjuster and a continuous variable valve lifter including the same in accordance with an exemplary embodiment of the present invention.

In the following detailed description, only certain exemplary embodiments of the present invention have been shown and described.

As those skilled in the art would realize, the described embodiments may be modified in various different ways, all without departing from the spirit or scope of the present disclosure.

Throughout the specification, the same reference numerals represent the same components.

An exemplary embodiment of the present invention will hereinafter be described in detail with reference to the accompanying drawings.

Figure 2:
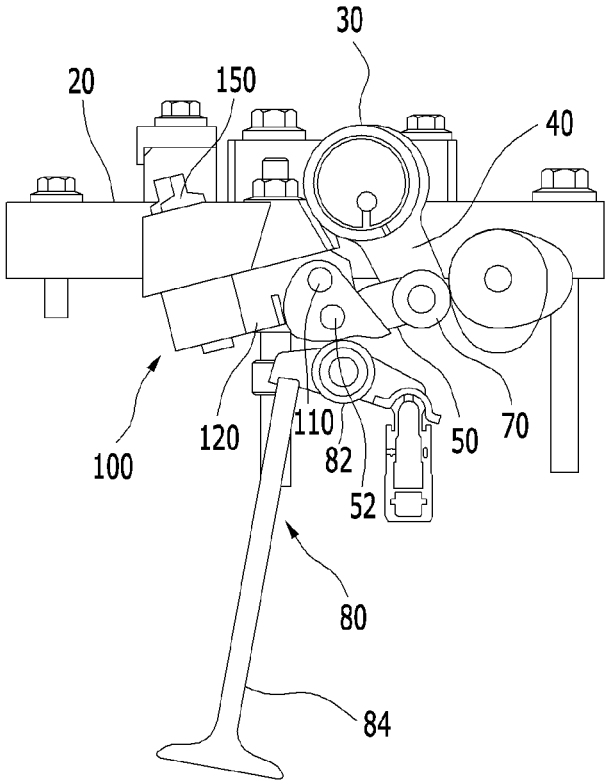
FIG. 2 is a cross-sectional view taken along line II-II of FIG. 1.

FIG. 1 is a top plan view of a cylinder air volume difference adjuster and a continuous variable valve lifter including the same in accordance with a first exemplary embodiment of the present invention. FIG. 2 is a cross-sectional view taken along line II-II of FIG. 1.

Figure 3:
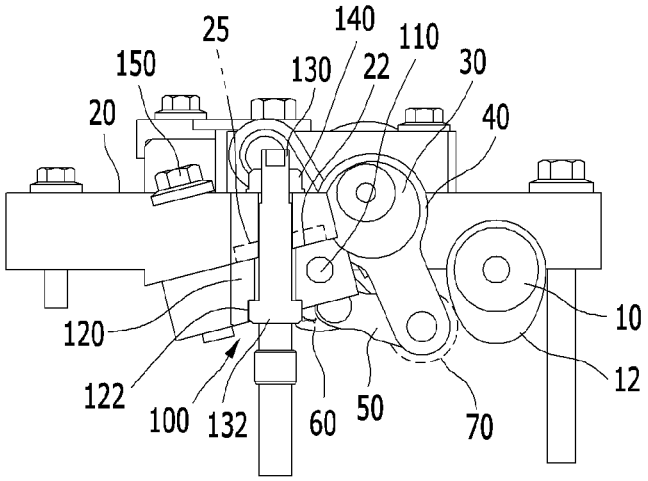
FIG. 3 is a cross-sectional view taken along line III-III of FIG. 1.
Figure 4:
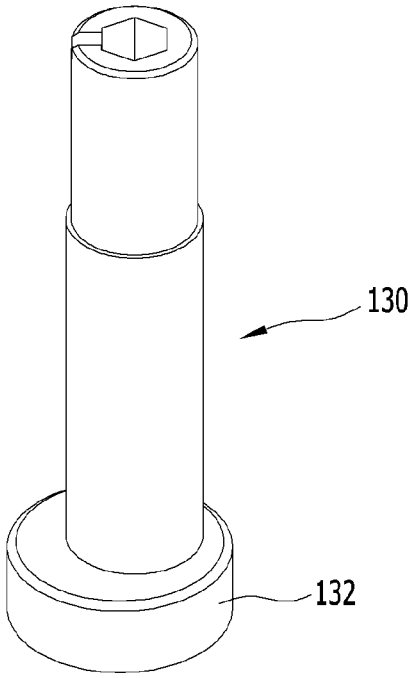
FIG. 4 is a perspective view showing an adjusting bolt of the cylinder air volume difference adjuster in accordance with the exemplary embodiment of the present invention.

FIG. 3 is a cross-sectional view taken along line III-III of FIG. 1. FIG. 4 is a perspective view showing an adjusting bolt of the cylinder air volume difference adjuster in accordance with an exemplary embodiment of the present invention.

Referring to FIGS. 1 through 4, a cylinder air volume difference adjuster and a continuous variable valve lifter in accordance with a first exemplary embodiment of the present invention will be described.

The continuous variable valve lifter including the cylinder air volume difference adjuster includes a camshaft 10 having an input cam 12, an eccentric control shaft 30 disposed parallel to the camshaft 10, a control link 40 rotating around the eccentric control shaft 30, and a valve actuator for opening/closing 80. An output cam 60 is provided to open and close the valve actuator 80. A connection link 50 is rotatably connected to the control link 40 and drives the output cam 60 by the rotating the input cam 12. The continuous variable valve lifter including the cylinder air volume difference adjuster further includes a cam cap 20 where the camshaft 10 and the eccentric control shaft 30 are mounted and the cylinder air volume difference adjuster 100.

A cam roller 70 may be disposed at a connecting portion of the control link 40 and the connecting link 50 and contacting the input cam 12. The valve actuator 80 may be a swing arm valve, and may include a swing arm roller 82 that is in contact with the output cam 60 and a valve 84. The connecting link 50 and the output cam 60 are connected by a connecting link hinge pin 52. The connecting link 50 causes the output cam 60 to pivot around the hinge pin 110.

The cylinder air volume difference adjuster 100 includes a hinge pin 110 serving as the rotational center of the output cam 60, and disposed parallel to the camshaft 10, a pin holder 120 where the hinge pin 110 is mounted, and an adjusting bolt 130 for selectively shifting the position of the pin holder 120.

The adjusting bolt 130 has an adjusting bolt eccentric cam 132. By selectively rotating the adjusting bolt 130, the adjusting bolt eccentric cam 132 moves the pin holder 120, and thus, adjusts the difference in the air volume of each cylinder.

An adjustment hole 122 is formed in the pin holder 120. The adjusting bolt eccentric cam 132 is inserted into the adjustment hole 122, thus moving the pin holder 120 along with the rotation of the adjusting bolt 130.

The cylinder air volume difference adjuster 100 may further include an adjusting bolt lock nut 140 for fixing the adjusting bolt 130 in the cam cap 20, and a lock bolt 150 for fixing the pin holder 120 to the cam cap 20.

The bottom of the cam cap 20 may be inclined, and the pin holder 120 may move along an inclined surface 22 of the cam cap 20.

As shown in FIG. 3, a guide slot 25 is formed in the cam cap 20, and the pin holder 120 may move along the inclined surface 22.

Referring to FIGS. 1 to 4, an air volume difference adjustment method for the cylinder air volume difference adjuster and the continuous variable valve lifter in accordance with an exemplary embodiment of the present invention will be described below.

When the engine is running, the eccentric control shaft 30 operates the continuous variable valve lifter in a low lift mode.

Hereupon, a control motor (not shown) controls the eccentric control shaft 30, and the control motor is operated by an engine control unit (ECU; not shown). The configurations and operations of the ECU and control motor in the cylinder air volume difference adjuster and the continuous variable valve lifter are obvious to those skilled in the art, so detailed description thereof will be omitted.

Referring to FIG. 2, when the control link 40 rotates counterclockwise around the eccentric control shaft 30 by the eccentric control shaft 30, rotation of the output cam 60 pivoting around the hinge pin 110 is shifted counterclockwise relative to the hinge pin 110, and therefore the profile of the valve 84 becomes smaller.

When the operation mode of the continuous variable valve lifter is changed to the low lift mode, the adjusting bolt lock nut 140 and the lock bolt 150 are slightly loosened.

The volume of air drawn into the intake of each cylinder is measured, and the adjusting bolt 130 of each cylinder is rotated to adjust the air volume difference.

Rotation of the adjusting bolt 130 moves the pin holder 120 due to the eccentric shape of the adjusting bolt eccentric cam 132, and thus adjusting a difference in the air volume of each cylinder while the engine is running. The actual difference in air volume is measured and adjusted at the same time. After completing the adjustment, the adjusting bolt lock nut 140 and the lock bolt 150 are fastened together.

Figure 5:
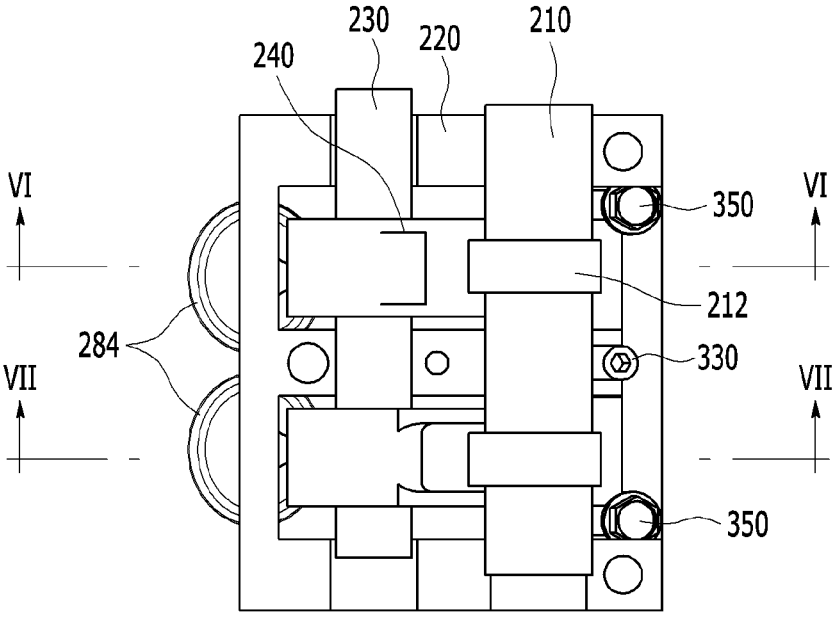
FIG. 5 is a top plan view of a cylinder air volume difference adjuster and a continuous variable valve lifter including the same in accordance with another exemplary embodiment of the present invention.
Figure 6:
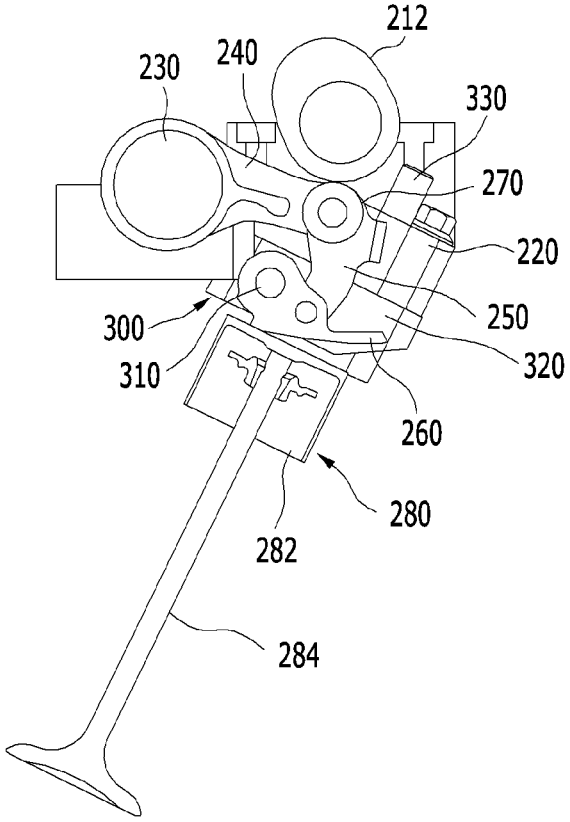
FIG. 6 is a cross-sectional view taken along line VI-VI of FIG. 5.
Figure 7:
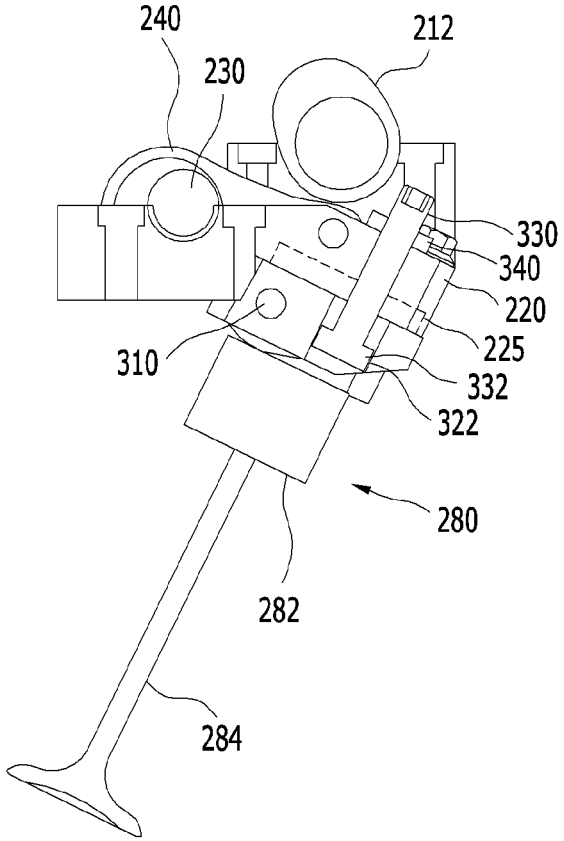
FIG. 7 is a cross-sectional view taken along line VII-VII of FIG. 5.

FIG. 5 is a top plan view of a cylinder air volume difference adjuster and a continuous variable valve lifter including the same in accordance with another exemplary embodiment of the present invention. FIG. 6 is a cross-sectional view taken along line VI-VI of FIG. 5. FIG. 7 is a cross-sectional view taken along line VII-VII of FIG. 5.

The continuous variable valve lifter including the cylinder air volume difference adjuster in accordance with another exemplary embodiment of the present invention includes a camshaft 210 having an input cam 212, an eccentric control shaft 230 disposed parallel to the camshaft 210, a control link 240 provided to be rotatable around the eccentric control shaft 230, and a valve actuator for opening/closing 280. An output cam 260 is provided to open and close the valve actuator 280, and a connection link 250 is rotatably connected to the control link 240, and driving the output cam 260 by rotation of the input cam 212. The continuous variable valve lifter further includes a cam cap 220 where the camshaft 210 and the eccentric control shaft 230 are mounted and the cylinder air volume difference adjuster 300.

A cam roller 270 may be disposed at a connecting portion of the control link 420 and the connecting link 250, and contacting the input cam 212.

The valve actuator for opening/closing 280 may be a tappet valve, and may include a tappet 282, that is in contact with the output cam 260, and a valve 284.

The cylinder air volume difference adjuster 300 includes a hinge pin 310 serving as the rotational center of the output cam 260, and disposed parallel to the camshaft 210, a pin holder 320 where the hinge pin 310 is mounted, and an adjusting bolt 330 for selectively shifting the position of the pin holder 320.

The connecting link 250 and the output cam 260 are connected by a connecting link hinge pin 252 causing the output cam 260 to pivot around the hinge pin 310.

The adjusting bolt 330 has an adjusting bolt eccentric cam 332. By selectively rotating the adjusting bolt 330, the adjusting bolt eccentric cam 332 moves the pin holder 320, thus adjusting a difference in the air volume of each cylinder.

An adjustment hole 322 is formed in the pin holder 320, and the adjusting bolt eccentric cam 332 is inserted into the adjustment hole 322, thus moving the pin holder 320 along with the rotation of the adjusting bolt 330.

The cylinder air volume difference adjuster 300 may further include an adjusting bolt lock nut 340 for fixing the adjusting bolt 330 in the cam cap 220, and include a lock bolt 350 for fixing the pin holder 320 to the cam cap 220. The bottom of the cam cap 220 may be inclined, and the pin holder 320 may move along an inclined surface 222 of the cam cap 220.

As shown in FIG. 7, a guide slot 225 is formed in the cam cap 220, so that the pin holder 320 may be provided to be movable along the inclined surface 222.

An air volume difference adjustment method for the cylinder air volume difference adjuster and the continuous variable valve lifter in accordance with another exemplary embodiment of the present invention is identical to the first exemplary embodiment of the present invention, so redundant description will be omitted.

As explained above, the cylinder air volume difference adjuster and the continuous variable valve lifter in accordance with the first and second exemplary embodiments of the present invention are capable of direct measurement of the volume of air drawn into cylinders and at the same time adjusting a difference in air volume, while the engine is running, thereby allowing precise adjustment of the difference in air volume and shortening the adjustment time.

While the disclosure has been described in connection with what is presently considered to be practical exemplary embodiments, it is to be understood that the disclosure is not limited to the disclosed embodiments. On the contrary, it is intended to cover various modifications and equivalent arrangements included within the spirit and scope of the appended claims.

What is claimed is:

1. A cylinder air volume difference adjuster, which is applied to a continuous variable valve lifter comprising a camshaft having an input cam, an eccentric control shaft disposed parallel to the camshaft, a control link provided to be rotatable around the eccentric control shaft, a valve actuator for opening/closing, an output cam provided to open and close the valve actuator, a connection link rotatably connected to the control link, and driving the output cam by the rotation of the input cam, and a cam cap where the camshaft and the eccentric control shaft are mounted, the cylinder air volume difference adjuster comprising:

a hinge pin serving as the rotational center of the output cam, and disposed parallel to the camshaft;

a pin holder where the hinge pin is mounted; and an adjusting bolt for selectively shifting the position of the pin holder.

2. The cylinder air volume difference adjuster of claim 1, wherein the adjusting bolt has an adjusting bolt eccentric cam formed thereon, and the adjusting bolt eccentric cam moves the pin holder by selectively rotating the adjusting bolt, thus adjusting a difference in the air volume of each cylinder.

3. The cylinder air volume difference adjuster of claim 2, wherein an adjustment hole is formed in the pin holder, and the adjusting bolt eccentric cam is inserted into the adjustment hole thus moving the pin holder along with the rotation of the adjusting bolt.

4. The cylinder air volume difference adjuster of claim 2, further comprising an adjusting bolt lock nut for fixing the adjusting bolt in the cam cap.

5. The cylinder air volume difference adjuster of claim 2, further comprising a lock bolt for fixing the pin holder to the cam cap.

6. The cylinder air volume difference adjuster of claim 1, wherein the bottom of the cam cap is inclined, and the pin holder moves along an inclined surface of the cam cap.

7. A continuous variable valve lifter comprising:

a camshaft having an input cam;

an eccentric control shaft disposed parallel to the camshaft;

a control link rotatable around the eccentric control shaft;

a valve actuator for opening/closing;

an output cam provided to open and close the valve actuator;

a connection link rotatably connected to the control link, and driving the output cam by rotating the input cam;

a cam cap where the camshaft and the eccentric control shaft are mounted; and a cylinder air volume difference adjuster, the cylinder air volume difference adjuster comprising:

a hinge pin serving as the rotational center of the output cam, and disposed parallel to the camshaft;

a pin holder where the hinge pin is mounted; and an adjusting bolt for selectively shifting the position of the pin holder.

8. The continuous variable valve lifter of claim 7, wherein the adjusting bolt has an adjusting bolt eccentric cam formed thereon, and the adjusting bolt eccentric cam may move the pin holder by selectively rotating the adjusting bolt, and thus adjust a difference in the air volume of each cylinder.

9. The continuous variable valve lifter of claim 8, wherein an adjustment hole is formed in the pin holder, and the adjusting bolt eccentric cam is inserted into the adjustment hole thus moving the pin holder along with the rotation of the adjusting bolt.

10. The continuous variable valve lifter of claim 8, further comprising an adjusting bolt lock nut for fixing the adjusting bolt in the cam cap.

11. The continuous variable valve lifter of claim 8, further comprising a lock bolt for fixing the pin holder to the cam cap.

12. The continuous variable valve lifter of claim 7, wherein the bottom of the cam cap is inclined, and the pin holder moves along an inclined surface of the cam cap.

13. The continuous variable valve lifter of claim 7, wherein a cam roller is disposed at a connecting portion of the control link and the connecting link and come into contact with the input cam.

14. The continuous variable valve lifter of claim 7, wherein the valve actuator for opening/closing is a swing arm valve.

15. The continuous variable valve lifter of claim 7, wherein the valve actuator for opening/closing is a tappet valve.

* * * * *